US006051798A

United States Patent [19]

Mittal

[11] Patent Number: 6,051,798

[45] Date of Patent: Apr. 18, 2000

[54] METHOD AND APPARATUS FOR CONSTRUCTING AN A/B SWITCH

[75] Inventor: Faquir C. Mittal, Audubon, Pa.

[73] Assignee: General Instrument Corporation, Horsham, Pa.

[21] Appl. No.: 09/144,196

[22] Filed: Aug. 31, 1998

[51] Int. Cl.[7] ..... H01R 9/09

[52] U.S. Cl. ..... 200/292; 439/63; 439/76.1

[58] Field of Search ..... 200/292, 51.02, 200/51.03, 303; 439/43, 63, 76.1; 361/687, 736

[56] References Cited

U.S. PATENT DOCUMENTS 3,883,705 5/1975 Sebastian et al. ..... 200/303 X 5,096,427 3/1992 Sadigh-Behzadi ..... 439/76.1

5,813,867 9/1998 Hodge ..... 439/63

*Primary Examiner*—Renee S. Luebke

*Attorney, Agent, or Firm*—Rader, Fishman & Grauer; Ronald P. Kananen

[57] ABSTRACT

A method for construction of an A/B switch is accomplished by press fitting two components of the switch together. The first component includes a circuit board with the switch circuitry. The circuit board is surrounded by an inner housing. An outer housing provides the output terminals for connecting the switch to other equipment. The outer housing has protrusions formed thereon for engaging and securing the inner housing when the inner and outer housings are press fit together.

20 Claims, 3 Drawing Sheets

METHOD AND APPARATUS FOR CONSTRUCTING AN A/B SWITCH

FIELD OF THE INVENTION

The present invention relates to the field of electrical switch manufacture. More specifically, the present invention relates to the field of A/B switch construction or the construction of similar electrical switching devices such as an R.F. bypass.

BACKGROUND OF THE INVENTION

A/B switches are most commonly used in the electrical connections between television sets and related equipment. The A/B switch provides a means whereby an incoming television signal can be switched between two alternate signal paths, i.e., A and B. With an A/B switch installed, a viewer can switch between the two signal paths as needed without disconnecting and reconnecting the television and related equipment in a new configuration.

An example of the use of an A/B switch is illustrated in FIG. 1. FIG. 1 shows a television set 104 which is connected through an A/B switch 103 to two sources of television signals.

In this particular example, the viewer is a cable subscriber and consequently has a cable outlet 101 through which the cable television signal is provided. However, the viewer also has an antenna 102 through which a different television signal can be received. The antenna may be part of a satellite system which the viewer uses in addition to the cable system. Alternatively, the cable system may not provide over-the-air broadcast channels which the viewer can receive with the antenna.

In any event, the viewer has two sources of television signals, the cable outlet 101 and the antenna 102. By connecting both the cable outlet 101 and the antenna 102 to the A/B switch 103, the viewer can use the A/B switch to alternately connect the television 104 to the antenna 102 or the cable outlet 101 depending on what the viewer wants to watch. Without the A/B switch, the viewer would have to disconnect the television 104 from either the cable outlet 101 or the antenna 102 in order to receive the television signals from the other signal source.

Another example of the use of an A/B switch is illustrated in FIG. 2. In FIG. 2, the viewer's only source of television signals is a cable outlet 201. However, some of the channels provided by the cable system are "premium" channels. Premium channels are only available to subscribers paying additional fees and are usually scrambled to prevent unauthorized subscribers from receiving them.

In order for a subscriber to receive a premium channel, some type of decoder or descrambling device must be provided to the subscriber. Usually, the descrambler is only provided upon the payment of the additional fees for the premium channel. The subscriber then incorporates the descrambler into the connection between his television set and cable outlet so that the descrambler can unscramble the premium channel before it is received by the television set. The television set can then properly receive the premium channel.

In some cable systems, a set-top terminal 203 is used as the tuner for the cable system. In other words, the television set 206 remains tuned to a single channel. The subscriber then uses the set-top terminal 203 to change the channel being received. The set-top terminal 203 in such a system may also include the descrambler, if any, for premium channels the subscriber has paid to receive.

This creates a problem if the subscriber wishes to record a program on a premium channel while watching another, unscrambled channel. The premium channel can only be received with the aid of the descrambler in the set-top terminal 203. But then the set-top terminal 203 cannot be used to tune the other channel the viewer desires to watch.

This problem can be solved with a splitter 202 and an A/B switch 204 as illustrated in FIG. 2. The splitter 202 is connected directly to the cable outlet 201 and splits the cable signal sending it to both the A/B switch 204 and the set-top terminal 203. The set-top terminal 203 is connected to the VCR (video cassette recorder) 205 which is, in turn, connected to the A/B switch. With this configuration, the A/B switch can provide the television with either a direct signal from the cable outlet 101 via the splitter 202, or a signal from the VCR 205 via the set-top terminal 203.

Under normal circumstances, the viewer will use the set-top terminal 203 to tune the various channels available. The signal is passed with or without recording through the VCR 205 to the television set 206.

If, however, the subscriber wishes to record a premium channel while watching another, unscrambled channel, the subscriber will switch the A/B switch so that the television 206 receives a signal directly from the cable outlet 201 via the splitter 202. In this manner, the VCR 205 still receives and can record the premium channel which has been unscrambled by the set-top terminal 203. Meanwhile, the subscriber can use the television set itself to tune among the other available, unscrambled channels that he or she wishes to watch.

As seen from these two examples, A/B switches have a wide variety of applications for increase the flexibility with which television sets are connected to accompanying signal sources and equipment. However, the methods for constructing A/B switches, particularly where the A/B switch might be incorporated with or connected to a set-top terminal, remain relatively inefficient.

Consequently, there is a need in the art for an improved method of constructing an A/B switch or similar electrical switching devices.

SUMMARY OF THE INVENTION

It is an object of the present invention to meet the above-described needs and others. Specifically, it is an object of the present invention to provide an improved method and device for constructing an A/B switch. As will be clear to those skilled in this art, the method of the present invention may be applied to the construction of other electrical switching devices such as an RF bypass.

Additional objects, advantages and novel features of the invention will be set forth in the description which follows or may be learned by those skilled in the art through reading these materials or practicing the invention. The objects and advantages of the invention may be achieved through the means recited in the attached claims.

To achieve the stated and other objects, the present invention may be embodied as a method of constructing an A/B switch by press fitting a first component into a second component. The second component includes an outer housing which provides a plurality of output terminals. The first component includes a circuit board, bearing the circuitry of the A/B switch, which is surrounded by an inner housing sized to fit within the outer housing.

The press fitting preferably includes the step of engaging the inner housing with protrusions on the outer housing. The press fitting also results in the output terminals electrically engaging connectors disposed on the circuit board.

In somewhat more detail, the method of the present invention includes disposing the circuitry of the A/B switch on a circuit board; surrounding the circuit board with an inner housing; supporting a plurality of output terminals on an outer housing, the outer housing being sized to receive the inner housing; and press fitting the inner housing into the outer housing so as to electrically connect the output terminals with the circuitry.

The step of disposing circuitry may include wave soldering the necessary circuit components to the circuit board. The step of surrounding the circuit board with the inner housing may be accomplished by wrapping a strip of sheet metal around an outer edge of the circuit board to form the inner housing.

The step of press fitting preferably includes forming protrusions on an upper lip of the outer housing; and engaging the inner housing with those protrusions to secure the inner housing in the outer housing. The step of electrically connecting the output terminals to the circuitry on the circuit board may be accomplished by forming female entry connectors on the circuit board, forming male pin connectors on the inner surface of the outer housing, and engaging the pin connectors in the entry connectors when the press fitting is performed.

Aside from this method, the present invention also encompasses an A/B switch and the components thereof designed for carrying out the foregoing method. Specifically, the present invention includes an A/B switch which is composed of a circuit board bearing the circuitry of the A/B switch; an inner housing surrounding and supporting the circuit board; an outer housing in which the inner housing is engaged; and a plurality of output terminals disposed on the outer housing and electrically connected to the circuitry. Preferably, the circuit board is a printed circuit board.

A dedicated connector may be provided on the circuit board for connecting the A/B switch to a set-top terminal. The electrical connection between the output terminals and the switch circuitry is preferably provided as follows. A plurality of male pin connectors are disposed on the inner surface of the outer housing and are electrically connected respectively to the output terminals. The output terminals are located on the outer surface of the outer housing. A plurality of respective female entry connectors are provided on the circuit board and engage the male pin connectors when the inner and outer housings are engaged.

Preferably, the engagement of the inner and outer housing is accomplished by protrusions on the outer housing for engaging the inner housing.

BRIEF DESCRIPTION OF THE DRAWINGS

The accompanying drawings illustrate the present invention and are a part of the specification. Together with the following description, the drawings demonstrate and explain the principles of the present invention.

DETAILED DESCRIPTION OF THE PREFERRED EMBODIMENTS

Using the drawings, the preferred embodiments of the present invention will now be explained.

Figure 1:
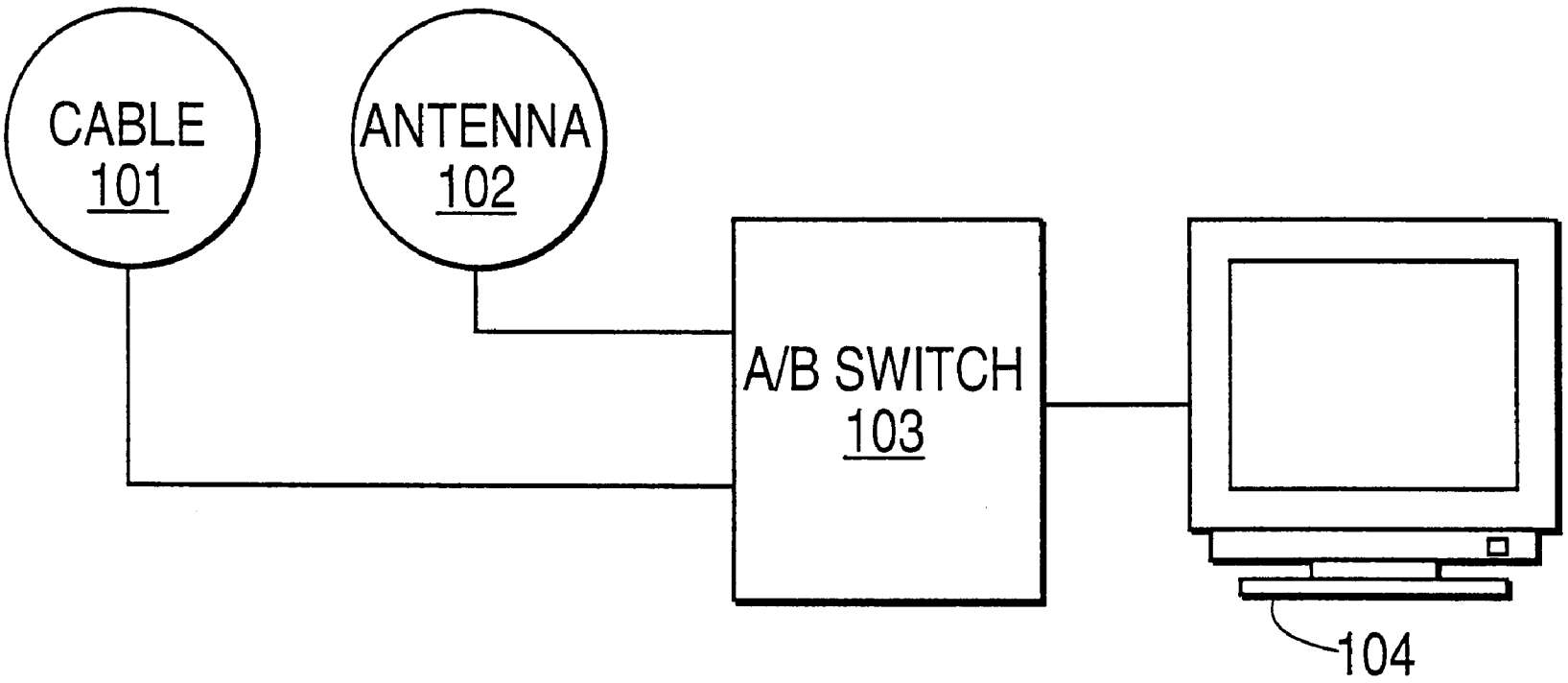
FIG. 1 (PRIOR ART)
FIG. 1 is a block diagram of a conventional use of an A/B switch.
Figure 2:
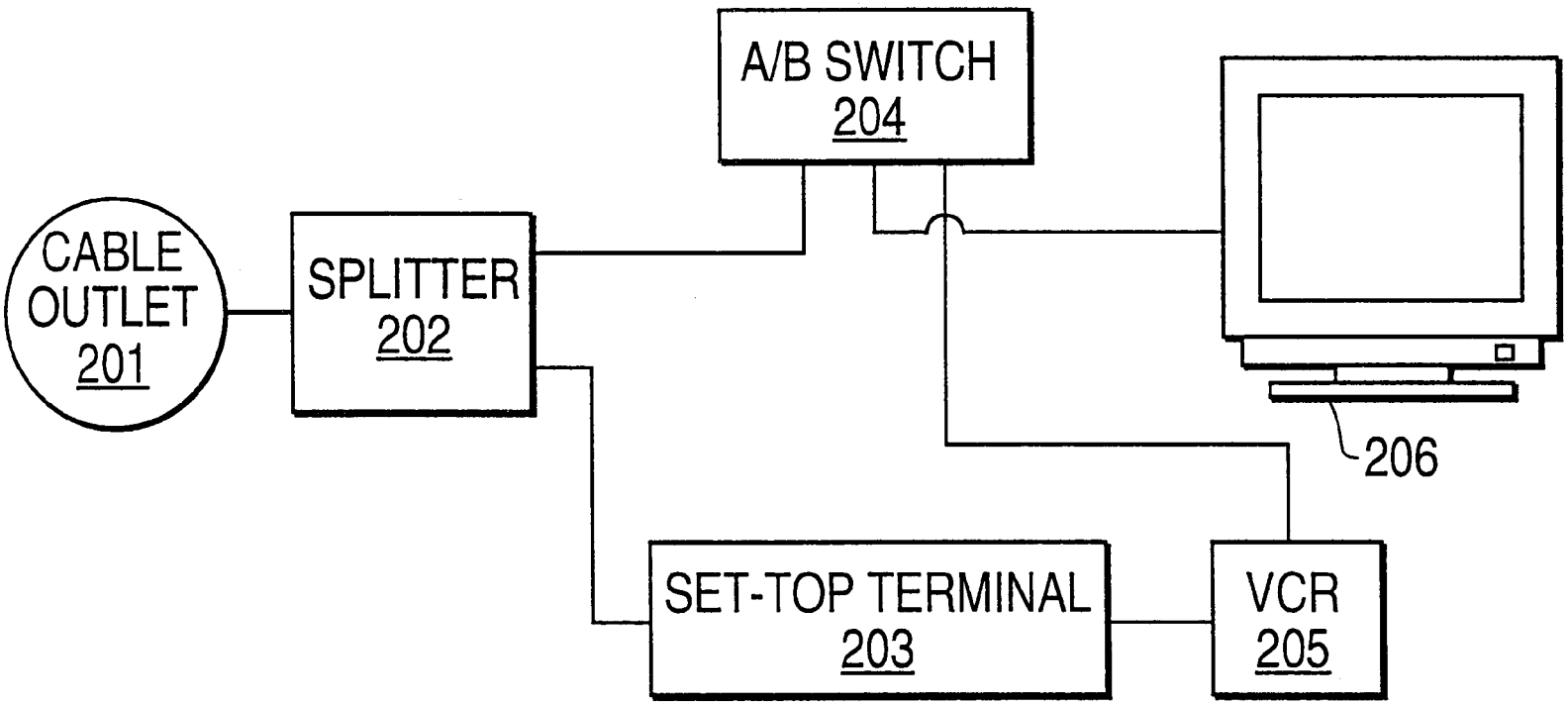
FIG. 2 (PRIOR ART)
FIG. 2 is a block diagram of a second conventional use of an A/B switch.
Figure 3:
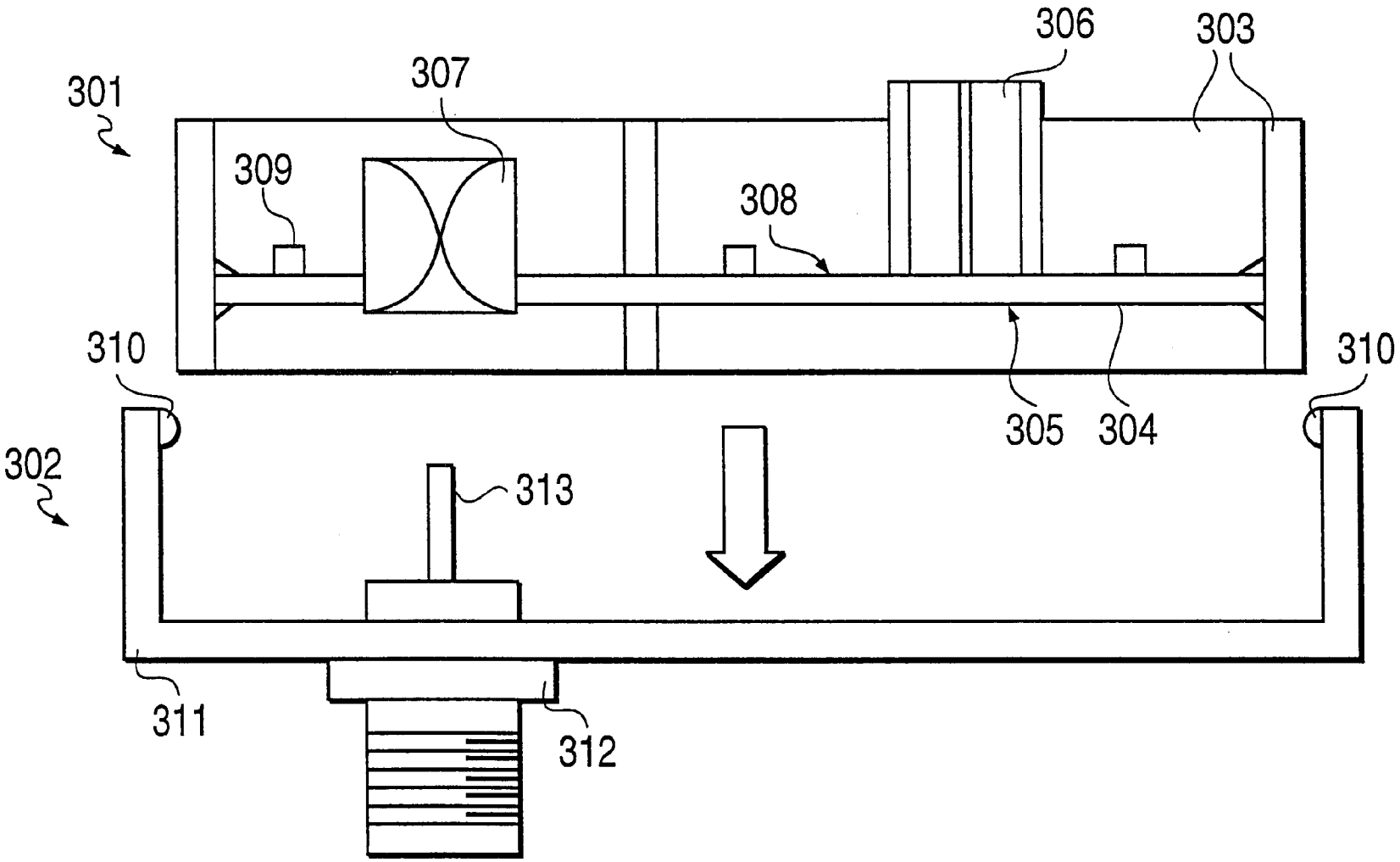
FIG. 3 is an illustration of an A/B switch which is constructing according to the principles of the present invention.

FIG. 3 illustrates two components of an A/B switch according to the principles of the present invention. The first component 301 includes the internal circuitry of the A/B switch. The second component 302 provides the external casing and connection terminals of the A/B switch. The particular A/B switch illustrated in FIG. 3 is specifically designed for connection to a set-top terminal (not shown).

The first component 301 consists of a printed circuit board 304 on which the circuitry necessary for the A/B switch is provided. The printed circuit board 304 has a component side 308. Electrical circuit components, e.g. 309, are provided on the component side 308 of the printed circuit board 304.

The opposite side of the circuit board 304 is the solder side 305. On the solder side 305 of the circuit board 304, the components are electrically connected to each other to form the circuit of the A/B switch. This may be accomplished by wave soldering.

The circuit board 304 also includes in its circuit two or more entry connectors. The entry connectors 307 are female connectors for making the connection between the circuit board 304 and the terminals 312 by which the various signal sources or electronic equipment are connected to the A/B switch.

For simplicity, only a single entry connector 307 is illustrated in FIG. 3. However, those skilled in the art will appreciate that two, three, four or more entry connectors may be provided depending on the type of electrical switching device being constructed under the principles of the present invention. For an A/B switch, as in the present example, two entry connectors would be provided.

Finally, the circuit board 304 includes a terminal connector 306 for connecting the switch to a set-top terminal (not shown). This terminal connector 306 is illustrated here only for purposes of the specific example being discussed of an A/B switch for use directly with a set-top terminal and does not limit the present invention.

The circuit board 304 is surrounded by a housing 303 which is preferably made of sheet metal. The housing 303 is a strip which encircles and secures the circuit board 304, but remains open at the top and bottom.

The second component 302 of the A/B switch shown in FIG. 3 includes a housing 311 which is sized to contain the housing 303 of the first component 301. Protrusions 310 are provided, as shown in FIG. 3, on the upper lip of the housing 311. These protrusions engage the inner housing 303 of the first component 301 to secure the inner housing 303 in the outer housing 311.

The outer housing 311 also supports two or more output terminals 312 which, as mentioned above, are used to connected the A/B switch to signal sources and electronic equipment. Again, for the sake of simplicity, only a single output terminal 312 is illustrated. The terminal 312 includes a pin 313 which is a male connector for engaging a respective entry connector 307 on the circuit board 304.

The A/B switch of the present invention is assembled according to the following novel method. The inner housing 303 of the first component 301 is press fit into the outer housing 311 of the second component 302 as illustrated by the arrow in FIG. 3. The first component 301 is pressed into the second 302 until the two "snap" together, i.e. the protrusions 310 engage the upper part of the inner housing 303. This also causes the pins 313 of the terminals 312 to engage their respective entry connectors 307.

Finally, in the specific example illustrated in FIG. 3, the joined first and second components 301 and 302 are connected to a set-top terminal (not shown) via the connector 306. The set-top terminal then covers the open portion of both the inner 303 and outer 311 housings.

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. An A/B switch assembly comprising:

a circuit board on which is disposed circuitry of an A/B switch;

an inner housing surrounding and supporting said circuit board;

an outer housing in which said inner housing is engaged, wherein said inner housing is press-fit into said outer housing; and at least one output terminal disposed on said outer housing and electrically connected to said circuitry of said A/B switch.

2. An A/B switch as claimed in claim 1, wherein said circuit board is a printed circuit board.

3. An A/B switch as claimed in claim 1, further comprising:

a male pin connector disposed on an inner surface of said outer housing which is electrically connected to said output terminal disposed on an outer surface of said outer housing; and a respective female entry connector on said circuit board engaging said male pin connector.

4. An A/B switch as claimed in claim 1, further comprising protrusions on said outer housing for engaging said inner housing.

5. An A/B switch as claimed in claim 4, wherein said protrusions engage an upper surface of said inner housing when said inner housing is press-fit into said outer housing.

6. An A/B switch comprising:

a circuit board on which is disposed circuitry of said A/B switch;

an inner housing surrounding and supporting said circuit board;

an outer housing in which said inner housing is engaged;

at least one output terminal disposed on said outer housing and electrically connected to said circuitry; and a connector on said circuit board for connecting said A/B switch to a set-top terminal.

7. An A/B switch as claimed in claim 6, wherein said circuit board is a printed circuit board.

8. An A/B switch as claimed in claim 6, further comprising:

a male pin connector disposed on an inner surface of said outer housing which is electrically connected to said output terminal disposed on an outer surface of said outer housing; and a respective female entry connector on said circuit board engaging said male pin connector.

9. An A/B switch as claimed in claim 6, further comprising protrusions on said outer housing for engaging said inner housing.

10. An A/B switch as claimed in claim 9, wherein said protrusions engage an upper surface of said inner housing when said inner housing is press-fit into said outer housing.

11. An A/B switch comprising:

a circuit board on which is disposed circuitry of said A/B switch;

an inner housing surrounding and supporting said circuit board;

an outer housing in which said inner housing is engaged, wherein said inner housing is press-fit into said outer housing;

at least one output terminal disposed on said outer housing and electrically connected to said circuitry; and a connector on said circuit board for connecting said A/B switch to a set-top terminal.

12. An A/B switch as claimed in claim 11, wherein said circuit board is a printed circuit board.

13. An A/B switch as claimed in claim 11, further comprising:

a male pin connector disposed on an inner surface of said outer housing which is electrically connected to said output terminal disposed on an outer surface of said outer housing; and a respective female entry connector on said circuit board engaging said male pin connector.

14. An A/B switch as claimed in claim 11, further comprising protrusions on said outer housing for engaging said inner housing.

15. An A/B switch as claimed in claim 14, wherein said protrusions engage an upper surface of said inner housing when said inner housing is press-fit into said outer housing.

16. An A/B switch assembly comprising:

a circuit board on which is disposed circuitry of an A/B switch;

an inner housing surrounding and supporting said circuit board;

an outer housing in which said inner housing is engaged; and at least one output terminal disposed on said outer housing and electrically connected to said circuitry of said A/B switch.

17. An A/B switch as claimed in claim 15, wherein said circuit board is a printed circuit board.

18. An A/B switch as claimed in claim 15, further comprising:

a male pin connector disposed on an inner surface of said outer housing which is electrically connected to said output terminal disposed on an outer surface of said outer housing; and a respective female entry connector on said circuit board engaging said male pin connector.

19. An A/B switch as claimed in claim 16, further comprising protrusions on said outer housing for engaging said inner housing.

20. An A/B switch as claimed in claim 19, wherein said protrusions engage an upper surface of said inner housing when said inner housing is press-fit into said outer housing.

* * * * *